US011548004B2

(12) United States Patent
Mogi et al.

(10) Patent No.: US 11,548,004 B2
(45) Date of Patent: Jan. 10, 2023

(54) METHOD FOR PRODUCING RADIOACTIVE COMPOSITION

(71) Applicants: NATIONAL INSTITUTE OF ADVANCED INDUSTRIAL SCIENCE AND TECHNOLOGY, Tokyo (JP); KYOTO PHARMACEUTICAL UNIVERSITY, Kyoto (JP)

(72) Inventors: Katsuo Mogi, Tokyo (JP); Tohru Natsume, Tokyo (JP); Shungo Adachi, Tokyo (JP); Tomoya Inoue, Tsukuba (JP); Hiroyuki Kimura, Kyoto (JP)

(73) Assignees: National Institute of Advanced Industrial Science and Technology, Tokyo (JP); Kyoto Pharmaceutical University, Kyoto (JP)

( * ) Notice: Subject to any disclaimer, the term of this patent is extended or adjusted under 35 U.S.C. 154(b) by 65 days.

(21) Appl. No.: 17/317,273

(22) Filed: May 11, 2021

(65) Prior Publication Data

US 2021/0387197 A1 Dec. 16, 2021

(30) Foreign Application Priority Data

May 19, 2020 (JP) ..... JP2020-087511

(51) Int. Cl.
*B01L 3/00* (2006.01)

(52) U.S. Cl.
CPC ..... *B01L 3/502792* (2013.01); *B01L 3/50273* (2013.01); *B01L 2300/0819* (2013.01); *B01L 2400/0427* (2013.01)

(58) Field of Classification Search
CPC ..... B01L 2300/0645; B01L 2300/0819; B01L 2300/0829; B01L 2300/0851;
(Continued)

(56) References Cited

U.S. PATENT DOCUMENTS

2006/0039828 A1* 2/2006 Yasuda ..... B01L 3/502792 422/82.08
2010/0046084 A1* 2/2010 Kirita ..... G02B 26/005 359/666

OTHER PUBLICATIONS

Javed et al "Efficient Radiosynthesis of 3'-Deoxy-3'-18F-Fluorothymidine Using Electrowetting-on-Dielectric Digital Microfluidic Chip" Journal of Nuclear Medicine Feb. 2014, 55 (2) 321-328 (Year: 2014).*

(Continued)

*Primary Examiner* — Jennifer Wecker
*Assistant Examiner* — Jonathan Bortoli
(74) *Attorney, Agent, or Firm* — Myers Bigel, P.A.

(57) ABSTRACT

A method for producing a liquid reaction mixture containing a radioisotope, in particular, a radioactive composition, minimizes device contamination with radioactive substances and increase speed and accuracy with which droplets are mixed. The method for producing a radioactive composition includes placing at least one first droplet L1 containing a radionuclide and at least one second droplet L2 containing a labeling substance on at least two respective dimples 5 among dimples 5 on a front surface 4*b* of an insulating layer 4 of a liquid manipulation device 1, and obtaining a liquid mixture M by using a change in electrostatic force caused by changing voltage applied to the electrodes 3 to thereby cause a relative movement between the at least one first droplet L1 and the at least one second droplet L2 so that the at least one first droplet L1 and the at least one second droplet L2 are mixed together at any one dimple among the dimples 5.

4 Claims, 4 Drawing Sheets

(58) Field of Classification Search
CPC ..... B01L 2300/165; B01L 2400/0427; B01L 3/50273; B01L 3/502792
See application file for complete search history.

(56) References Cited

OTHER PUBLICATIONS

Kawashima, Hidekazu , et al., "Application of Microreactor to the Preparation of C-11-Labeled Compounds via O-[11C]Methylation with [11C]CH3I: Rapid Synthesis of [11C]Raclopride", Chemical and Pharmaceutical Bulletin, vol. 63, No. 9, Jan. 1, 2015, pp. 737-740.

* cited by examiner

METHOD FOR PRODUCING RADIOACTIVE COMPOSITION

CROSS-REFERENCE TO RELATED APPLICATION

The present application claims the benefit of and priority to Japanese Patent Application No. 2020-087511, filed on May 19, 2020, the disclosure of which is incorporated herein as if set forth in its entirety.

TECHNICAL FIELD

The present invention relates to a method for producing a radioactive composition using a liquid manipulation device.

BACKGROUND ART

In fields of technology such as biotechnology, medicine, and drug development, many different drugs are increasingly being manufactured in low volumes with advances in personalized medicine. In such low-volume, broad-variety production of drugs, there is demand for automated preparation because rare reagents, dangerous chemical agents, and/or the like are handled in some cases, and are necessary to prepare different drugs.

For example, in preparation of drugs, two types of liquid reagents containing a radioisotope may be mixed together for purposes such as PCR labeling. As an example of technology for automating such mixing, a device is disclosed in Non-Patent Document 1. The device includes a microreactor chip including two inlets, one outlet, and a passageway of a meandering closed space, extending from the two inlets and merging into a Y-shape before reaching the one outlet. The device also includes a syringe pump and two microsyringes operated by the syringe pump. Each of the microsyringes is coupled to a corresponding one of the two inlets. The two microsyringes introduce two respective liquid reagents of different types through the two respective inlets. The two liquid reagents are mixed together while passing through the passageway, whereby a liquid reaction mixture is provided and is collected at the one outlet.

CITATION LIST

Non-Patent Document

Non-Patent Document 1: Hidekazu Kawashima and eight others, "Application of Microreactor to the Preparation of C-11-Labeled Compounds via 0-[$^{11}$C]Methylation with [$^{11}$C]$CH_3I$: Rapid Synthesis of [$^{11}$C]Raclopride", Chemical and Pharmaceutical Bulletin, Volume 63, No. 9, pp. 737-740, accepted Jun. 18, 2015

SUMMARY OF INVENTION

Technical Problem

A device including a microreactor chip, a syringe pump, and two microsyringes, as in the example technology described above, is large and is complicated. Thus, using such technologies presents difficulty in handling rare reagents, dangerous chemical agents, and/or the like, thereby resulting in reduced accuracy in manipulating droplets. Enormous costs, incurred to appropriately process radioisotope possibly remaining in each device, may be a further problem. Additionally, use of the technologies described above poses difficulty in rapid handling an RI reagent and/or the like that degrade quickly in effect.

In view of circumstances described above, in a method for producing a liquid reaction mixture containing a radioisotope, in particular, a radioactive composition, there is demand for minimization of device contamination with radioactive substances as well as increase in speed and accuracy in the mixing of droplets.

Solution to Problem

As a solution to the problems, the present inventors have achieved a method for producing a radioactive composition using a liquid manipulation device that is open to the outside, as disclosed in the document by Katsuo Mogi and four others, "Electrowetting on Dielectric (EWOD) Device with Dimple Structures for Highly Accurate Droplet Manipulation", Applied Sciences. 2019, Volume 9, Issue 12, 2406, 9 pages, published Jun. 13, 2019." This liquid manipulation device is configured to manipulate a droplet based on EWOD (electrowetting-on-dielectric). More specifically, the liquid manipulation device includes a substrate made using paper and/or the like, electrodes located on a front surface of the substrate, and an insulating layer located on the front surface of the substrate to cover the electrodes. The insulating layer has a back surface facing the front surface of the substrate, and a front surface located opposite the back surface of the insulating layer with respect to a thickness direction of the insulating layer. The insulating layer includes dimples at locations corresponding to respective locations of the electrodes. The dimples are curved concave in a concave direction directed from the front surface of the insulating layer toward the back surface of the insulating layer. Each of the electrodes includes a dimple-corresponding portion curved concave in the concave direction together with one of the dimples at the corresponding location. The liquid manipulation device is configured to change electrostatic force generated based on application of voltage to the electrodes to stop a droplet at a dimple and to move the droplet between dimples.

A method for producing a radioactive composition according to one aspect of the present invention uses a liquid manipulation device, the liquid manipulation device including a substrate, electrodes located on a front surface of the substrate, and an insulating layer located on the front surface of the substrate to cover the electrodes, the insulating layer having a back surface facing the front surface of the substrate, and a front surface located opposite the back surface of the insulating layer with respect to a thickness direction of the insulating layer, the insulating layer including dimples at locations corresponding to respective locations of the electrodes, the dimples being curved concave in a concave direction directed from the front surface of the insulating layer toward the back surface of the insulating layer, each of the electrodes including a dimple-corresponding portion curved concave in the concave direction together with one of the dimples at a corresponding location, and includes placing at least one first droplet containing a radionuclide and at least one second droplet containing a labeling substance on at least two respective dimples among the dimples on the front surface of the insulating layer, and obtaining a liquid mixture by using a change in electrostatic force caused by changing voltage applied to the electrodes to thereby cause a relative movement between the at least one first droplet and the at least one second droplet so that the at least one first droplet and the at least one second droplet are mixed together at any one dimple among the dimples.

Advantageous Effects of Invention

In the method for producing a radioactive composition according to one aspect, a first droplet and a second droplet can be mixed together with increased speed and accuracy. Also, reaction can be accelerated between a compound contained in the first droplet and a compound contained in the second droplet. Furthermore, a very small amount of a radioactive composition can be produced by the production method, with the contamination level minimized, thus, the production method is extremely advantageous from economic and safety viewpoints.

DESCRIPTION OF EMBODIMENT

Figure 1:
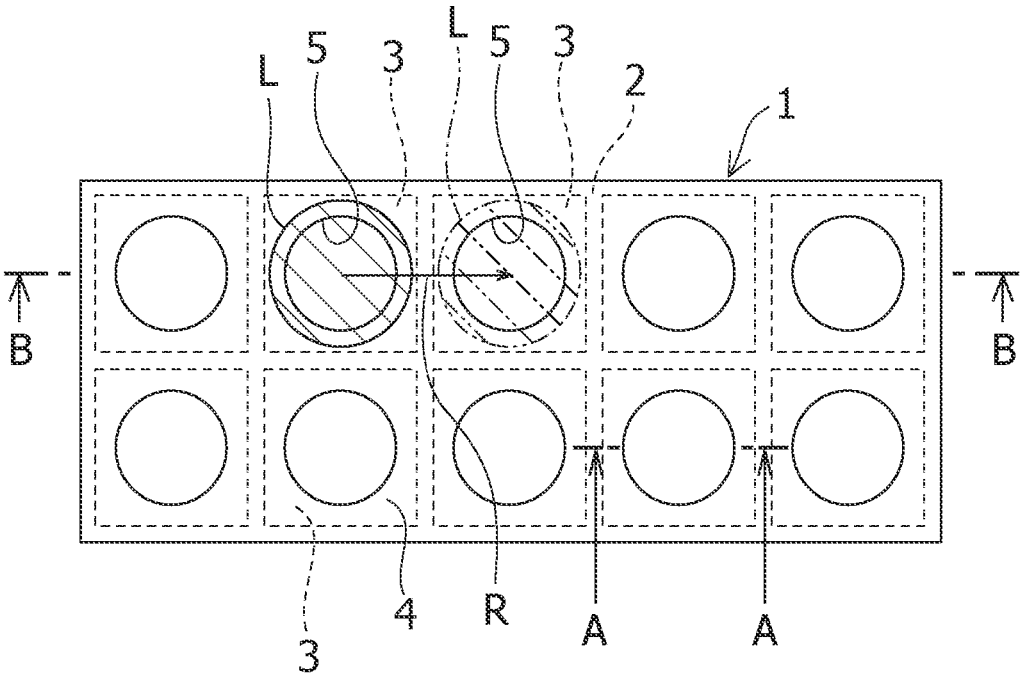
FIG. 1 is a plan view schematically showing a liquid manipulation device used for a method for producing a radioactive composition according to an embodiment.

A method for producing a radioactive composition according to an embodiment is described below.

Outline of Method for Producing Radioactive Composition With reference to FIGS. 1 to 7, an outline of a method for producing a radioactive composition according to the present embodiment is described below. The method for producing a radioactive composition according to the present embodiment is, in outline, as described below.

The production method produces a radioactive composition using a liquid manipulation device 1. The liquid manipulation device 1 is described first in outline below with reference to FIGS. 1 and 2. The liquid manipulation device 1 includes a substrate 2. The substrate 2 has a back surface 2*a*, and a front surface 2*b* located opposite the back surface 2*a* with respect to a thickness direction of the substrate 2. The liquid manipulation device 1 includes electrodes 3 located on the front surface 2*b* of the substrate 2. The liquid manipulation device 1 includes an insulating layer 4 located on the front surface 2*b* of the substrate 2 to cover the electrodes 3.

The insulating layer 4 has a back surface 4*a* facing the front surface 2*b* of the substrate 2, and a front surface 4*b* located opposite the back surface 4*a* of the insulating layer 4 with respect to a thickness direction of the insulating layer 4. The insulating layer 4 includes dimples 5 curved concave in a concave direction directed from the front surface 4*b* of the insulating layer 4 toward the back surface 4*a* of the insulating layer 4. The dimples 5 are placed at locations corresponding to respective locations of the electrodes 3. Each of the electrodes 3 includes a dimple-corresponding portion 6 curved concave in the concave direction together with one of the dimples 5 at the corresponding location.

As shown in FIGS. 1 and 3A to 3C, the liquid manipulation device 1 is configured to change electrostatic force obtained based on application of voltage to the electrodes 3 to thereby stop a droplet L and a liquid mixture M at respective dimples 5. The liquid mixture M is described hereinafter. The liquid manipulation device 1 is also configured to change the electrostatic force to thereby cause a movement of each of the droplet L and the liquid mixture M between two adjacent dimples among the dimples 5 at least once.

As used herein, the term "droplet," when used simply as "droplet," collectively indicates first to third droplets to be described hereinafter and other droplets. In FIGS. 1 and 4 to 7 to be described hereinafter, a droplet L before it is moved is indicated by a solid line, and the droplet L after it is moved is indicated by a phantom line, which is a two-dot chain line.

Figure 4:
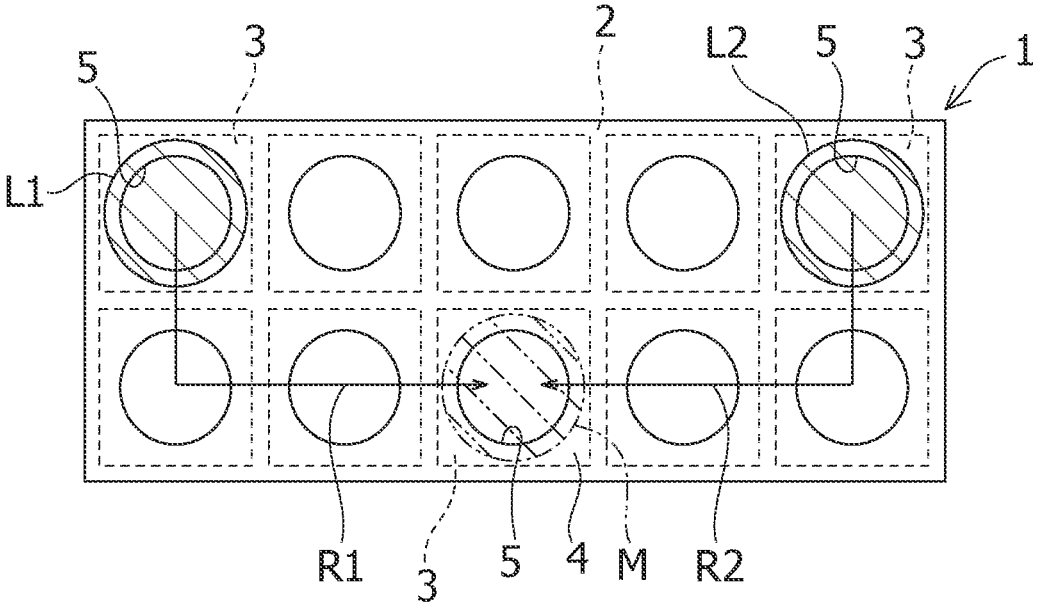
FIG. 4 is a plan view schematically showing the liquid manipulation device in a state in which a step of placing one first droplet and one second droplet has been performed in an example of the method for producing a radioactive composition according to the embodiment.
Figure 5:
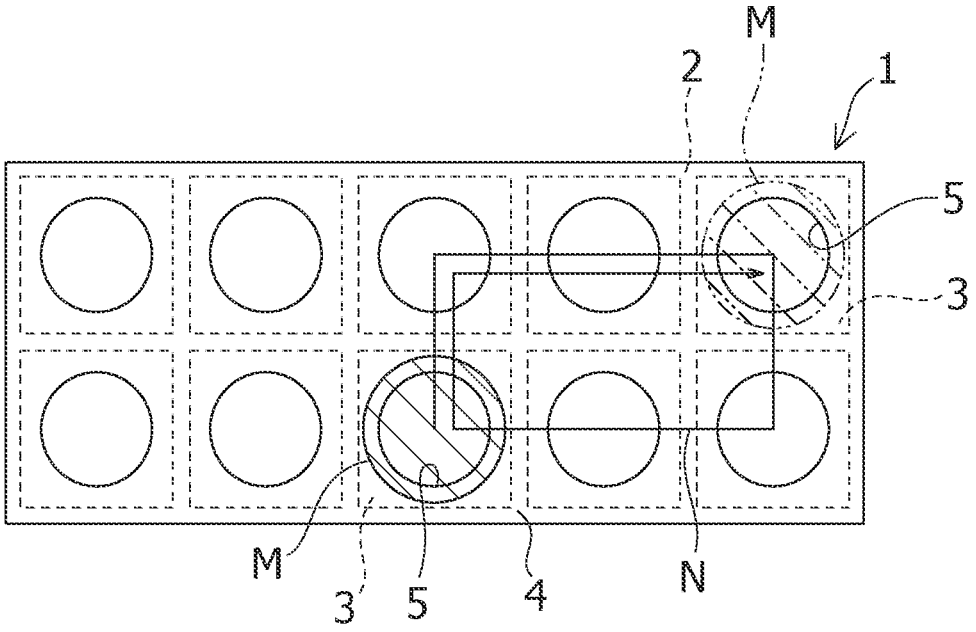
FIG. 5 is a plan view schematically showing the liquid manipulation device in a state in which a step of obtaining a liquid mixture by mixing the one first droplet and the one second droplet together has been performed in the example of the method for producing a radioactive composition according to the embodiment.

As shown in FIG. 4, the method for producing a radioactive composition using the liquid manipulation device 1 described above includes a step of placing at least one first droplet L1 containing a radionuclide and at least one second droplet L2 containing a labeling substance on at least two respective dimples among the dimples 5 on the front surface 4*b* of the insulating layer 4 (a placing step). As shown in FIGS. 4 and 5, the production method includes a step of obtaining a liquid mixture M by using a change in electrostatic force caused by changing voltage applied to the electrodes 3 to thereby cause a relative movement between the at least one first droplet L1 and the at least one second droplet L2 so that the at least one first droplet L1 and the at least one second droplet L2 are mixed together at any one dimple among the dimples 5 (a mixing step).

As used herein, a "liquid mixture" indicates a solution resulting from mixing two or more types of droplets, and a symbol M is added to the term "liquid mixture" as needed. Thus, a "liquid mixture M" collectively indicates a solution resulting from mixing first and second droplets L1 and L2, a solution resulting from mixing first to third droplets L1 to L3 to be described hereinafter, and a solution resulting from mixing first to third droplets L1 to L3 and any other droplets. In the production method according to the present invention, when, for example, a starting substance in a first droplet L1 and a starting substance in a second droplet L2 react with one another to generate a composition containing a radiopharmaceutical substance, which is a reaction product, the proportion of the components in the liquid mixture M can change over time as the reaction progresses, nonetheless, as used herein, the liquid mixture M indicates a solution obtained after the mixing regardless of such change in the liquid mixture M.

Figure 6:
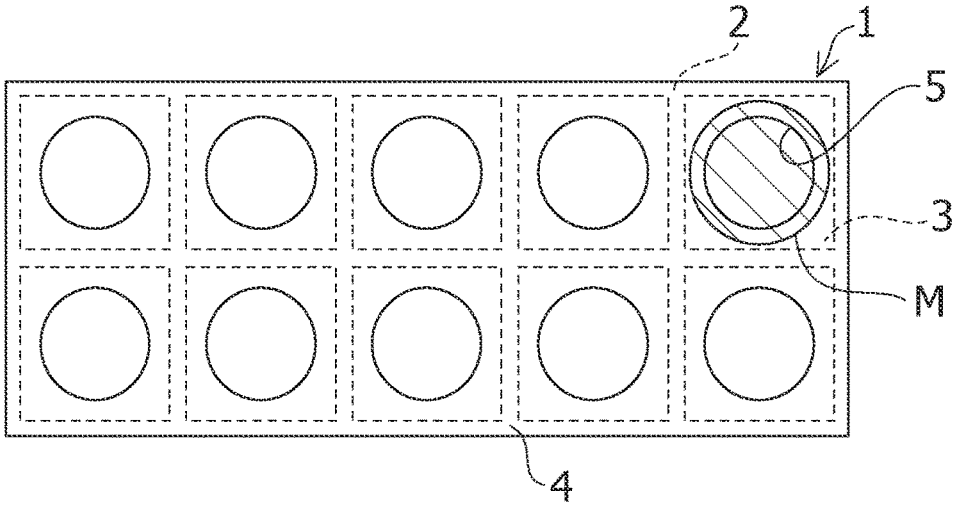
FIG. 6 is a plan view schematically showing the liquid manipulation device in a state in which a step of stirring the liquid mixture has been performed in the example of the method for producing a radioactive composition according to the embodiment.

Furthermore, the method for producing a radioactive composition according to the present embodiment can be, in outline, as described below. As shown in FIGS. 5 and 6, the method for producing a radioactive composition further includes a step of stirring the liquid mixture M by using a change in the electrostatic force to thereby cause a movement of the liquid mixture M between two adjacent dimples among the dimples 5 at least once (a stirring step).

A radioactive composition is a solution containing a radiopharmaceutical substance. A first droplet L1 comprises a solution containing a radionuclide. The first droplet L1 can contain one starting substance out of starting substances used for producing a radioactive composition. Alternatively, the first droplet L1 can be the one starting substance. A second droplet L2 comprises a solution containing a labeling substance. The second droplet L2 can contain another starting substance out of the starting substances used for preparing the radioactive composition. Alternatively, the second droplet L can be the other starting substance. A radionuclide-containing compound in the first droplet L1 and the labeling substance in the second droplet L2 react with one another to generate a radiopharmaceutical substance, which is a target substance (a reaction product). The radioactive composition contains a radiopharmaceutical substance and can contain a component, such as an additive agent and a solvent.

Figure 7:
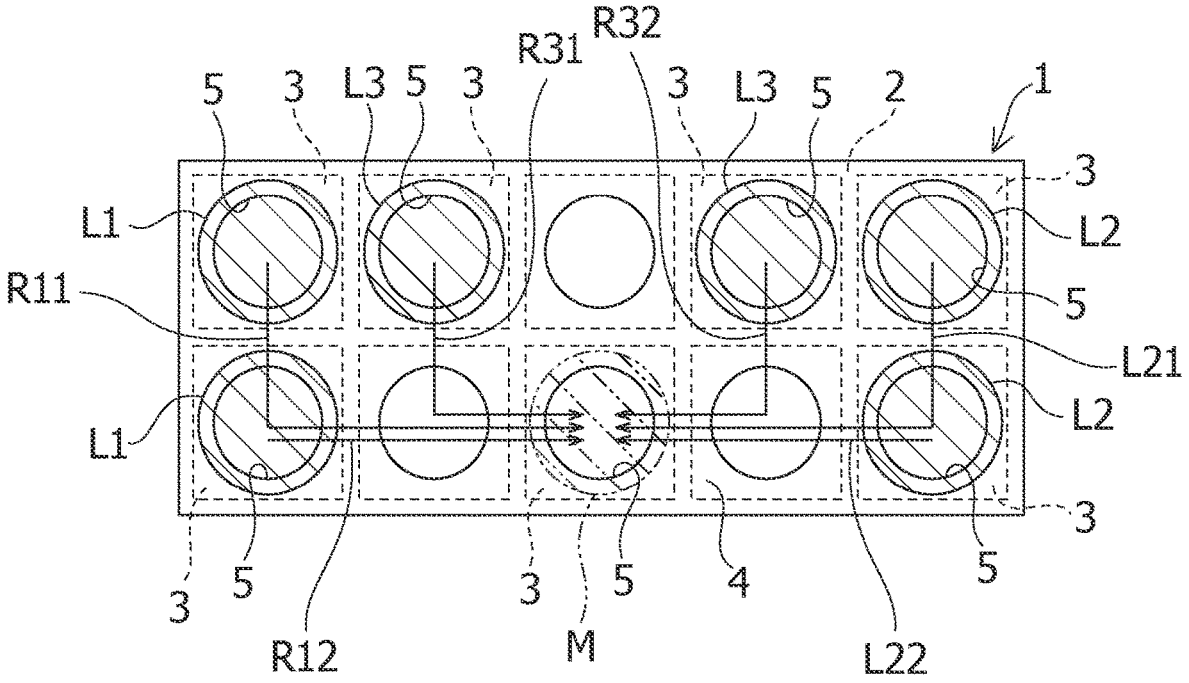
FIG. 7 is a plan view schematically showing the liquid manipulation device in a state in which a step of placing two first droplets, two second droplets, and two third droplets has been performed in another example of the method for producing a radioactive composition according to the embodiment.

As shown in FIG. 7, in the placing step, at least one third droplet L3 containing a pH adjuster is also placed on at least one dimple among the dimples 5, the at least one dimple being different from the at least two respective dimples 5 at which the at least one first droplet L1 and the at least one second droplet L2 are placed. Furthermore, as shown in FIGS. 5 and 7, in the mixing step, by using a change in the electrostatic force, a relative movement is caused between the at least one first droplet L1, the at least one second droplet L2, and the at least one third droplet L3 so that the at least one first droplet L1, the at least one second droplet L2, and the at least one third droplet L3 are mixed together at any one dimple among the dimples 5.

Liquid Manipulation Device in Detail

Figure 2:
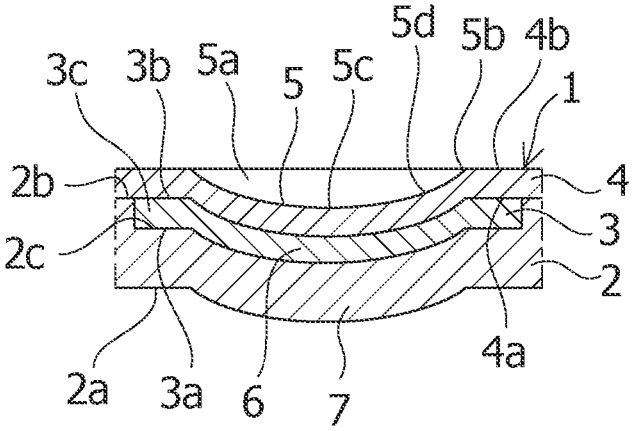
FIG. 2 is a sectional view taken along line A-A of FIG. 1.

With reference to FIGS. 1 to 3, the liquid manipulation device 1 can be configured as described below in detail. As shown in FIGS. 1 and 2, the substrate 2 of the liquid manipulation device 1 has a sheet shape or a film shape so as to be flexible. As described herein, a "film" indicates an object having a layer shape and having a thickness of approximately 200 μm (micrometer) or less, and a "sheet" indicates an object having a layer shape and having a thickness exceeding approximately 200 μm.

In FIG. 2, the substrate 2 includes concave portions 2*c* that are concave to correspond to the respective electrodes 3. The substrate 2 also includes second dimple-corresponding portions 7 at locations corresponding to respective locations of the first dimple-corresponding portions 6 of the electrodes 3.

Each of the second dimple-corresponding portions 7 is curved concave in the concave direction together with the first dimple-corresponding portion 6 of one of the electrodes 3 at the corresponding location and one of the dimples 5 of the insulating layer 4 at the corresponding location. The second dimple-corresponding portion 7 is located within the concave portion 2*c*. The back surface 2*a* of the substrate 2 includes portions that are convex at locations corresponding to respective locations of the second dimple-corresponding portions 7. Alternatively, the substrate can be formed to include the second dimple-corresponding portions and include no concave portions. The back surface of the substrate can be smooth or flat.

The thickness of the substrate 2 is set to allow plastic deformation of the substrate 2 together with the electrodes 3 and the insulating layer 4 during a dimple forming process, such as an embossing process. For example, the substrate 2 can be formed such that the electrodes 3 can be placed on the substrate 2 using, for example, a printer, such as an ink-jet printer.

The substrate 2 may be made using paper, resin, and/or the like. As used herein, "paper" indicates a material produced by aggregating plant fibers, other fibers, and/or the like, and may include an inorganic substance, such as a porous material, and organic molecules, such as synthetic molecules, added to it. As used herein, "resin" indicates a material including a natural and/or synthetic macromolecular compound as the principal component. The material may be a composite material further including fiber, an inorganic substance, and/or the like. In particular, the material may be thermoplastic resin having good thermal processability. In particular, the substrate 2 may be bendable. The substrate 2 may also be easily cuttable using a cutting tool, such as scissors and a cutter. The substrate 2 can be an injection molding made of resin.

The thickness of the substrate 2 is set such that the substrate 2 is flexible. For example, when the substrate 2 is made using paper or is a paper, the substrate 2 can have a thickness of approximately 100 μm to approximately 200 μm. When the substrate 2 is made using resin or is a resin, the substrate 2 may be a film having a thickness of approximately 200 μm or less. Alternatively, the substrate 2 made using resin or that is a resin may be a sheet having a thickness greater than approximately 200 μm. It is preferable that the substrate 2 not be made of glass or silicon. However, these are not limitations to the material and thickness of the substrate of the present invention. For example, when the back surface of the substrate is formed smooth or flat, the thickness of the substrate can be set such that the substrate is flexible, and such that the back surface of the substrate remains smooth or flat at locations corresponding to the locations of the second dimple-corresponding portions even after the dimple forming process is performed to form the dimples.

The electrodes 3 of the liquid manipulation device 1 are made of a conductive material. The conductive material may be metal, carbon, metallic oxide, a material containing at least one material among the materials set forth, or the like. The electrode 3 has a layer shape. The electrode 3 can be formed using, for example, a conductive ink. The thickness of the electrode 3 is set to allow plastic deformation of the electrode 3 and the insulating layer 4 together during the dimple forming process or the like.

The electrode 3 has a back surface 3*a* facing the front surface 2*b* of the substrate 2, and a front surface 3*b* located opposite the back surface 3*a* of the electrode 3 with respect to a thickness direction of the electrode 4. The electrode 3 also includes a perimeter portion 3*c* located on the outer periphery of the first dimple-corresponding portion 6. The perimeter portion 3*c* is located along the front surface 2*b* of the substrate 2.

In FIG. 2, the electrode 3 is located within the concave portion 2*c* of the substrate 2 with the front surface 3*b* of the electrode 3 substantially coincident with the front surface 2*b* of the substrate 2. If the substrate is formed to include the second dimple-corresponding portions and include no concave portions as described above, the perimeter portions of the electrodes can be located on the front surface of the substrate to protrude from the front surface of the substrate.

Each of the electrodes 3 is larger than the corresponding one of the dimples 5. The electrodes 3 are spaced apart from one another on the front surface 2*b* of the substrate 2. Furthermore, the electrodes 3 are arranged in a matrix with m rows and n columns on the front surface 2*b* of the substrate 2. As used herein, m is an integer of 1 or greater and n is an integer of 2 or greater. Alternatively, m is an integer of 2 or greater and n is an integer of 1 or greater. In an example in FIG. 1, 18 electrodes 3 are arranged in a matrix with two rows and five columns. The arrangement of the electrodes is not limited to a matrix. The electrodes may be located such that a desired movement route intended for liquid can be provided. For example, the electrodes can be arranged into a honeycomb matrix in which the shapes of the electrodes are not limited to substantially hexagonal shapes.

Figure 3A:
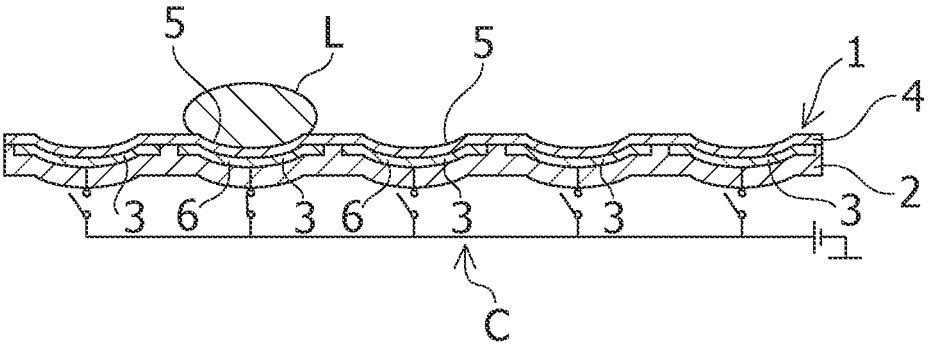
FIGS. 3A, 3B, and 3C are sectional views schematically showing the liquid manipulation devices taken along line B-B of FIG. 1, in a state before a droplet is moved, a state during the movement of the droplet, and a state after the droplet is moved, respectively.
Figure 3B:
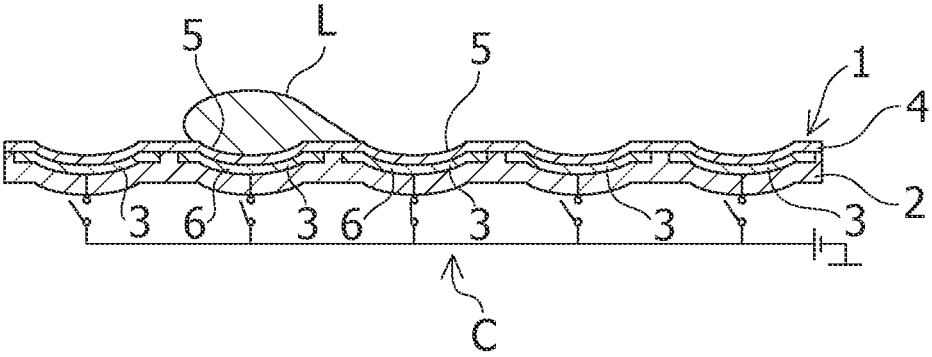
Figure 3C:
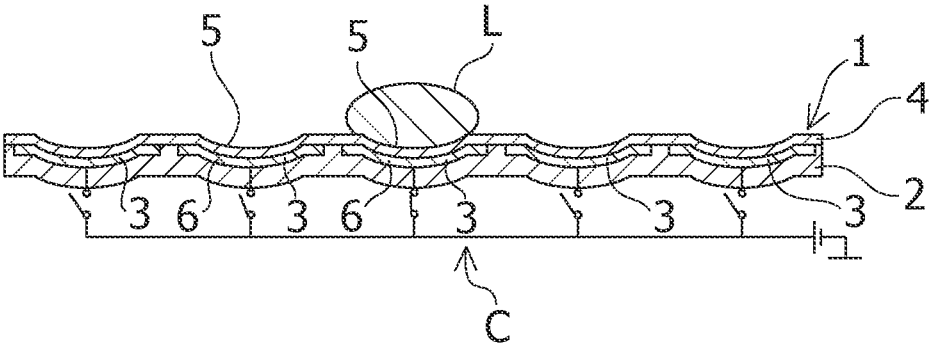

As shown in FIGS. 3A to 3C, the electrodes 3 are connected to a circuit C. The circuit C is configured to apply voltage to the electrodes 3 individually. In FIG. 1, the circuit C is located outside the substrate 2. However, this is not a limitation to the present invention. At least a portion of the circuit may be located in the substrate. For example, wiring of the circuit, which is a portion of the circuit, may be located in the substrate.

FIGS. 3A to 3C schematically show the circuit C including a switch, a power supply, grounding, and the like as an example to describe states in which voltage is applied to the electrodes 3 individually. However, the circuit connected to the electrodes is not limited to the circuit C shown in FIGS. 3 to 7. The circuit can have any configuration as long as voltage can be applied to the electrodes individually to generate electrostatic force for stopping and moving a droplet, such as the first to third droplets, and a liquid mixture.

As shown in FIGS. 1 and 2, the front surface 4*b* of the insulating layer 4 of the liquid manipulation device 1 is open to the outside. Thus, the liquid manipulation device 1 is an open type. Furthermore, the insulating layer 4 may be electrically insulating. The insulating layer 4, in particular, the front surface 4*b* of the insulating layer 4, may be hydrophobic. Thus, the insulating layer 4 may be made using an electrically insulating and hydrophobic material. The material may be an electrically insulating and hydrophobic resin, for example, fluororesin or the like. The front surface of the insulating layer can be made using a hydrophobic material or an electrically insulating and hydrophobic material, and the remaining portion of the insulating layer can be made using an electrically insulating material.

Each of the dimples 5 of the insulating layer 4 includes an opening portion 5*a* and an opening edge portion 5*b*. The opening portion 5*a* is open in the front surface 4*b* of the insulating layer 4. The opening edge portion 5*b* is located at the edge of the opening portion 5*a*, surrounding the opening portion 5*a*. The opening edge portion 5*b* has a substantially circular shape. However, the shape of the opening edge portion is not limited to a substantially circular shape. For example, the opening edge portion can have a substantially polygonal shape, such as a substantially rectangular shape and a substantially hexagonal shape, a substantially elliptical shape, or the like. The opening edge portion can have a curved corner.

The dimple 5 also includes a bottom portion 5*c*. The bottom portion 5*c* faces the opening portion 5*a* in the thickness direction of the insulating layer 4. Also, the bottom portion 5*c* is located toward the back surface 4*a* of the insulating layer 4 with respect to the opening portion 5*a*. The dimple 5 also includes a surrounding wall portion 5*d* extending between the opening edge portion 5*b* and the bottom portion 5*c*. The bottom portion 5*c* has a substantially arc shape that is concave in the concave direction. However, the shape of the bottom portion is not limited to a substantially arc shape. For example, the bottom portion can have a substantially flat shape. The bottom portion can have a substantially conic shape that is concave in the concave direction.

The surrounding wall portion 5*d* becomes narrower toward the bottom portion 5*c* from the opening edge portion 5*b*. The surrounding wall portion 5*d* has a substantially arc shape that is concave in the concave direction. However, the shape of the edge portion is not limited to a substantially arc shape. For example, the surrounding wall portion can extend substantially straight between the opening edge portion and the bottom portion.

The bottom portion 5*c* and the surrounding wall portion 5*d* of the dimple 5, having substantially arc shapes concave in the concave direction, have substantially the same curvatures. Alternatively, the bottom portion and the surrounding wall portion, having substantially arc shapes, can have different curvatures. Furthermore, the maximum depth of the dimple 5, the size of the opening edge portion 5*b* of the dimple 5, the shape of the dimple 5, and the like are defined such that liquid, in particular, a droplet L, can be retained continuously and stably in a position in which the dimple 5 is located, and the liquid, in particular, the droplet L, fitted on the dimple 5 can be moved smoothly.

Manipulation to Move Liquid

With reference to FIGS. 3A to 3C, manipulation to move a droplet L in the liquid manipulation device 1 is described below. As shown in FIG. 3A, the liquid manipulation device 1 is in a voltage application state in which a voltage is applied to one electrode 3 among the electrodes 3, and a voltage lower than the voltage applied to the one electrode 3, or no voltage, is applied to the remaining electrodes 3, or electrodes 3 located in the vicinity of the one electrode 3, among the electrodes 3. Due to electrostatic force generated in the voltage application state, and fitting of the droplet L on one dimple 5 corresponding to the one electrode 3 among the dimples 5, the droplet L is retained continuously and stably in one stop position at which the one dimple 5 is located.

As shown in FIG. 3B, the liquid manipulation device 1 is then in another voltage application state in which a voltage is applied to another electrode 3 located adjacent to the one electrode 3 among the electrodes 3, and a voltage lower than the voltage applied to the other electrode 3, or no voltage, is applied to the remaining electrodes 3, or electrodes 3 located in the vicinity of the other electrode 3, among the electrodes 3. Due to electrostatic force generated in the other voltage application state, the droplet L located in the one stop position is attracted to another stop position at which another dimple 5 corresponding to the other electrode 3 among the dimples 5 is located, as indicated by an arrow R (in FIG. 1). The droplet L moves from the one stop position to the other stop position.

As shown in FIG. 3C, due to the electrostatic force generated in the other voltage application state, and fitting of the droplet L on the other dimple 5, the droplet L is then stopped at the other stop position reliably and retained in the other stop position continuously and stably. In particular, the droplet L moving from the one stop position to the other stop position can be stopped at the other stop position reliably by the other dimple 5, countering the inertial force of the droplet L. A liquid mixture M can be manipulated to move similarly to a droplet L.

Radioactive Composition in Detail

A radioactive composition obtainable by the production method of the present invention is described below. The radioactive composition may contain a radiopharmaceutical substance, which is a reaction product of a radionuclide in a first droplet L1 and a labeling substance in a second droplet L2 described above. Optionally, the radioactive composition may also contain a solvent, a reaction terminator, an additive agent, and/or a pH adjuster contained in a third droplet L3. Nonlimiting examples of the radiopharmaceutical substance include: a technetium ($^{99m}$Tc) hydroxymethylene diphosphonate injection; a technetium ($^{99m}$Tc) methylenediphosphonate injection; a technetium ($^{99m}$Tc) tetrofosmin injection; an [N,N'-ethylenedi-L-cysteinate (3-)]oxotechnetium ($^{99m}$Tc) diethylester injection: a technetium ($^{99m}$Tc) labelled macroaggregated human serum albumin injection; a mercaptoacetylglycylglycylglycine technetium ($^{99m}$Tc) injection; a galactosyl human serum albumin diethylenetriamine pentaacetic acid technetium ($^{99m}$Tc) injection; a technetium ($^{99m}$Tc) phytic acid injection; a sodium pertechnetate ($^{99m}$Tc) injection; a technetium ($^{99m}$Tc) exametazime injection; a diethylenetriamine pentaacetic acid technetium ($^{99m}$Tc) injection; a technetium ($^{99m}$Tc) dimercaptosuccinic acid injection; a technetium ($^{99m}$Tc) tin colloid injection; a technetium ($^{99m}$Tc) human serum albumin injection; a human serum albumin diethylenetriamine pentaacetic acid technetium ($^{99m}$Tc) injection; a technetium ($^{99m}$Tc) N-pyridoxyl-5-methyltryptophan injection; a technetium ($^{99m}$Tc) pyrophosphate injection; a technetium ($^{99m}$Tc) hexakis(2-methoxyisobutylisonitrile) injection; a gallium ($^{67}$Ga) citrate injection; an indium ($^{111}$In) chloride injection; an indium ($^{111}$In) chloride solution (for ibritumomab tiuxetan, for pentetreotide); an indium ($^{111}$In) diethylenetriamine pentaacetate injection; an indium ($^{111}$In) oxyquinoline solution; a yttrium ($^{90}$Y) chloride solution; and yttrium ($^{90}$Y) ibritumomab tiuxetan. A radioactive composition produced by the method of the present invention is usable as it is or as diluted as appropriate, as a pharmaceutical for diagnosis with PET (positron emission tomography) or SPECT (single photon emission computed tomography) and/or as a pharmaceutical for radionuclide therapy, in the form of an injection, a solution, or the like.

First to Third Droplets and Liquid Mixture in Detail

First to third droplets L1 to L3 and a liquid mixture M are described in detail below. A first droplet L1 is a solution containing a radionuclide. A radionuclide contained in the first droplet L1 is determined by intended use and is not limited in particular. Examples include $^{3}$H, $^{11}$C, $^{14}$C, $^{13}$N, $^{15}$O, $^{18}$F, $^{32}$P, $^{44}$Sc, $^{51}$Cr, $^{59}$Fe, $^{60}$Co, $^{63}$Zn, $^{64}$Cu, $^{67}$Ga, $^{68}$Ga, $^{81m}$Kr, $^{89}$Sr, $^{89}$Zr, $^{90}$Y, $^{99m}$Tc, $^{111}$In, $^{123}$I, $^{124}$I, $^{125}$I, $^{131}$I, $^{133}$Xe, $^{137}$Cs, $^{192}$Ir, $^{198}$Au, $^{201}$Tl, $^{223}$Ra, $^{226}$Ra, $^{211}$At, $^{225}$Ac, $^{177}$Lu, and the like. Among them, $^{99m}$Tc, $^{111}$In, $^{67}$Ga, and $^{123}$I are useful as SPECT nuclides; $^{68}$Ga, $^{64}$Cu, $^{89}$Zr, $^{11}$C, $^{18}$F, $^{63}$Zn, and $^{44}$Sc are useful as PET nuclides: $^{90}$Y, $^{223}$Ra, $^{211}$At, $^{225}$Ac, $^{177}$Lu, $^{131}$I, and $^{89}$Sr are useful as radionuclide therapy nuclides: and $^{3}$H, and $^{14}$C are useful as nuclides with long half-lives. Among them, $^{99m}$Tc, $^{111}$In, $^{67}$Ga, $^{123}$I, $^{68}$Ga, $^{64}$Cu, $^{89}$Zr, $^{18}$F, $^{63}$Zn, $^{44}$Sc, $^{124}$I, $^{90}$Y, $^{223}$Ra, $^{211}$At, $^{225}$Ac, $^{177}$Lu, $^{131}$I, and $^{89}$Sr are preferably used because they can be caused to react easily by mixing at room temperature.

To prepare the first droplet L1, a radionuclide-containing compound (a salt) serving as a reaction starting substance can be dissolved in an appropriate solvent. Nonlimiting examples of the solvent include pure water, water for injection, physiological saline, various types of buffer, ethanol, dimethyl sulfoxide, other organic solvents, and the like. An organic solvent, if used, can be removed as required after reaction is completed. The first droplet L1 can further contain an optional additive. Nonlimiting examples of the additive include surfactants containing, for example, benzalkonium chloride, benzethonium chloride, benzethonium chloride solution, polyoxyethylene (40) monostearate (polyoxyl 40 stearate), sorbitan sesquioleate, polyoxyethylene (20) sorbitan monooleate (polysorbate 80), glyceryl monostearate, sodium lauryl sulfate, lauromacrogol, and/or the like. The concentration of a radionuclide in the first droplet L1 can be set as appropriate according to the purpose. With the method of the present invention, even a starting substance that would conventionally be unusable, due to risk of exposing the human body to radiation, can be used in high concentrations.

A second droplet L2 comprises liquid containing a labeling substance. Nonlimiting examples of the labeling substance include chelators, for example, 1,4,7,10-tetraazacyclododecane-1,4,7,10-tetraacetic acid (DOTA); 1,4,7-triazacyclononane-1,4,7-triacetic acid (NOTA); diethylene triamine pentaacetic acid (DTPA); triazacyclononane (TACN); diaminedithiols (DADT); diamidedithiols (DADS); monoaminomonoamido-dithiols (MAMA); mercaptoacetyltriglycine ($MAG_3$); hexamethylpropylene amine oxime (HMPAO); N,N'-ethylenebis(salicylaldimine) ($sal_2en$); N,N'-ethylenebis(acetylacetone imine) ($acac_2en$); N,N'-ethylene-bis(acetylacetone thioimine) ($sacac_2en$); N,N'-bis(2-mercaptoethyl)-2-(ethylthio)-ethylamine; 4-methoxythiophenol; 1-[(4-methoxyphenyl)amino]-2-methylpropane-2-thiol and 2-(mercaptomethyl)pyridine; glucoheptate; dimercaptosuccinic acid; N,N',N'',N'''-tetra-(tert-butoxycarbonyl)-6-(carboxy)-1,4,8,11-tetraazaundecane; (4,4-bis[-bis-hydroxymethyl-phosphonyl-propylcarbarmoyl]-butyric acid); N-methyl S-methyl dithiocarbazate hydrazine-2-pyridine(HYPY); 6-hydrazino-4-nicotinic acid (HYNIC); tris(2-mercaptoethyl)amine and isocyanide; hexakis(2-methoxy-isobutyl-isocyanide); histidine; iminodiacetic acid; 2-picolylamine-N-acetic acid; 2-picolylamine-N,N-diacetic acid; histamine; 2-picolinic acid; 2,4-dipicolinic acid; Thiele's acid; dicarba-closododecaborane; arenes (benzene and toluene); and the like. Besides the substances described above, the labeling substance may be a radioactive composition, in particular, any reagent for use in the field of radioactive compositions for diagnosis and therapy.

The second droplet L2 can be prepared by dissolving a labeling substance in an appropriate solvent. The solvent can be selected from alternatives similar to those for the solvent of the first droplet L1. The second droplet L2 may also contain an optional additive. The second droplet L2 may contain the same surfactant as that in the first droplet, but this is not limited thereto.

The labeling substance in the second droplet L2 is determined depending on the radionuclide in the first droplet L1. The combination of the radionuclide and the labeling substance may be a combination making up a radioactive composition among the examples described above. Alternatively, the combination may be a known combination of a radionuclide and a labeling substance for composing a radioactive composition. The combination of the radionuclide and the labeling substance is not limited in particular.

The first droplet L1 and/or the second droplet L2 can be prepared using a commercially available injection kit for a reagent for diagnosis with PET or SPECT.

The fluid volume of the first droplet L1 and the fluid volume of the second droplet L2 may be identical or the same as long as the fluid volume of the liquid mixture M after mixing is containable at a dimple 5. For instance, a dimple 5 having a diameter of approximately 2 mm can contain a droplet L of approximately 5 μL to 30 μL and allow the droplet L to move.

As used herein, one droplet L indicates a droplet L placed at one dimple 5. Thus, at least one droplet L can be placed at one dimple 5. Also, two or more droplets L can be placed at two or more dimples 5. For example, one first droplet L1 indicates a droplet placed at one dimple 5. In the present invention, at least one first droplet L1 can be placed at one dimple 5. Also, two or more first droplets L1 can be placed at two or more dimples 5. Two or more first droplets L1 can, in general, contain the same type of substance and have the same composition.

Furthermore, one second droplet L2, one third droplet L3, and one droplet other than the first to third droplets L1 to L3 can be similarly defined. For example, two or more second droplets L2 can be placed at two or more dimples 5. However, for example, the total fluid volume of one or more first droplets L1 and one or more second droplets L2 can be limited to a fluid volume that renders a liquid mixture M, resulting from mixing the one or more first droplets L1 and the one or more second droplets L2, containable at one dimple 5 and so as to be movable. Placing and mixing two or more droplets leads to advantages, such as an increased capacity.

A third droplet L3 comprises liquid containing a pH adjuster. The third droplet L3 may or may not be used depending on the type of radioactive composition to be obtained. The third droplet L3 is, in general, added to and mixed with a mixture of a first droplet L1 and a second droplet L2 after the first droplet L1 and the second droplet L2 are mixed together. Nonlimiting examples of the pH adjuster include, for example, hydrochloric acid, citric acid, acetic acid, sodium hydroxide, potassium hydroxide, sodium carbonate, phosphoric acid, and the like. Furthermore, the production method of the present invention may include steps of placing and mixing a fourth droplet, a fifth droplet, or further droplets containing a type of compound different from those of the first to third droplets L1 to L3, as required. The number and types of droplets to be mixed are not limited, as long as a liquid mixture M is containable on one dimple 5 and movable.

Detail of Method for Producing Radioactive Composition

With reference to FIGS. 4 to 7, one example and another example in the method for producing a radioactive composition according to the present embodiment are described below in detail. The method for producing a radioactive composition can be, in detail, as in the one example and the other example as described below.

One example of the method for producing a radioactive composition is described below. As shown in FIG. 4, in the placing step, one first droplet L1 containing a radionuclide and one second droplet L2 containing a labeling substance are placed at two different, respective dimples 5 on the front surface 4*b* of the insulating layer 4. The first droplet L1 and the second droplet L2 can be placed using a syringe or the like. This operation can be machine automated. As shown in FIGS. 4 and 5, in the mixing step, one liquid mixture M is obtained by using a change in electrostatic force as described above to thereby cause a relative movement between the one first droplet L1 and the one second droplet L2 so that the one first droplet L1 and one second droplet L2 are mixed together at one dimple 5.

As shown in FIGS. 5 and 6, in the stirring step, the one liquid mixture M is stirred by using a change in electrostatic force to thereby move the one liquid mixture M. As shown in FIG. 6, the method for producing a radioactive composition can optionally include, after the stirring step, a step of allowing the stirred solution to stand at one dimple 5. Furthermore, the method can include a step (a collecting step) of collecting one reaction product from a dimple 5. The collecting step can be performed using a syringe or the like as in the placing step, and this operation can be machine automated.

In FIG. 4, the one dimple 5 at which the first and second droplets L1 and L2 are mixed together in the mixing step is different from the two respective dimples 5 at which the first and second droplets L1 and L2 are placed in the placing step. However, the first and second droplets can be mixed together in the mixing step at one dimple out of the two respective dimples at which the first and second droplets are placed in the placing step. In this case, the first droplet or the second droplet placed at the one dimple out of the two dimples can stay at the one dimple in the mixing step.

In FIGS. 4 and 5, in the mixing step, a movement of each of the first and second droplets L1 and L2 between two adjacent dimples 5 is caused twice so that each of the first and second droplets L1 and L2 is moved toward the one dimple 5 at which the first and second droplets L1 and L2 are mixed together. In this mixing step, the first and second droplets L1 and L2 are moved in substantially L shapes, as indicated by respective arrows R1 and R2. However, one of the first droplet and the second droplet may remain at its original position in the mixing step, as described above. In the mixing step, each of the first and second droplets can be moved substantially straight, substantially in an L-shape, substantially in a U-shape, substantially zigzag, or the like.

In FIGS. 5 and 6, in the stirring step, a movement of the liquid mixture M between two adjacent dimples 5 is caused to move the liquid mixture M nine times toward one dimple 5 for collecting the liquid mixture M in the collecting step. In this stirring step, the liquid mixture M is moved substantially in a spiral fashion, as indicated by an arrow N. However, in the stirring step, a round trip of a liquid mixture between two adjacent dimples can be caused at least once. In the stirring step, a liquid mixture can be moved substantially straight, substantially in an L-shape, substantially in a U-shape, substantially zigzag, or the like.

Another example of the method for producing a radioactive composition is described below. As shown in FIG. 7, in the placing step, two first droplets L1 containing a radionuclide, two second droplets L2 containing a labeling substance, and two third droplets L3 containing a pH adjuster are placed at six different, respective dimples 5 on the front surface 4*b* of the insulating layer 4. As shown in FIGS. 5 and 7, in the mixing step, one liquid mixture M is obtained by using a change in electrostatic force, as described above, to thereby cause a relative movement between the two first droplets L1, the two second droplets L2, and the two third droplets L3 so that the two first droplets L1, the two second droplets L2, and the two third droplets L3 are mixed together at one dimple 5. As with the one example in the method for producing a radioactive composition described above, the stirring step and the collecting step are performed.

In FIG. 7, the one dimple 5 at which the first to third droplets L1 to L3 are mixed together in the mixing step is different from the six respective dimples 5 at which the first to third droplets L1 to L3, totaling to six, are placed in the placing step. However, the first and third droplets can be mixed together in the mixing step at one dimple among the six respective dimples at which the first to third droplets L1 to L3, totaling to six, are placed in the placing step. In this case, one of the first to third droplets placed at the one dimple among the six dimples can stay at the one dimple in the mixing step.

In FIGS. 5 and 7, in the mixing step, a movement of one first droplet L1 out of the two first droplets L1 between two adjacent dimples 5 is caused twice to move the one first droplet L1 toward the one dimple 5 at which the first to third droplets L1 to L3 are mixed together. A movement of the other first droplet L1 out of the two first droplets L1 between two adjacent dimples 5 is caused once to move the other first droplet L1 toward the one dimple 5 at which the first to third droplets L1 to L3 are mixed together.

A movement of one second droplet L2 out of the two second droplets L2 between two adjacent dimples 5 is caused twice to move the one second droplet L2 toward the one dimple at which the first to third droplets L1 to L3 are mixed together. A movement of the other second droplet L2 out of the two second droplets L2 between two adjacent dimples 5 is caused once to move the other second droplet L2 toward the one dimple 5 at which the first to third droplets L1 to L3 are mixed together.

A movement of one third droplet L3 out of the two third droplets L3 between two adjacent dimples 5 is caused twice to move the one third droplet L3 toward the one dimple 5 at which the first to third droplets L1 to L3 are mixed together. A movement of the other third droplet L3 out of the two third droplets L3 between two adjacent dimples 5 is caused twice to move the other third droplet L3 toward the one dimple 5 at which the first to third droplets L1 to L3 are mixed together. The third droplets L3 are preferably moved such that the third droplets L3 are added to a solution resulting from mixing together the first and second droplets L1 and L2, after the mixing of the first droplets L1 and the second droplets L2 is completed.

In this mixing step, the two first droplets L1 are moved in substantially L-shapes as indicated by respective arrows R11 and R12. The two second droplets L2 are moved substantially straight, as indicated by respective arrows R21 and R22. The two third droplets L3 are moved in substantially L-shapes, as indicated by respective arrows R31 and R32. However, one of the first to third droplets, totaling to six, can stay at its original position in the mixing step as described above. In the mixing step, each of the first to third droplets, totaling to six, can be moved substantially straight, substantially in an L-shape, substantially in a U-shape, substantially zigzag, or the like.

As described above, the method for producing a radioactive composition according to the present embodiment uses the liquid manipulation device 1 as described above. The liquid manipulation device 1 includes a substrate 2, electrodes 3 located on a front surface 2*b* of the substrate 2, and an insulating layer 4 located on the front surface 2*b* of the substrate 2 to cover the electrodes 3. The insulating layer 4 has a back surface 4*a* facing the front surface 2*b* of the substrate 2, and a front surface 4*b* located opposite the back surface 4*a* of the insulating layer 4 with respect to a thickness direction of the insulating layer 4. The insulating layer 4 includes dimples 5 at locations corresponding to respective locations of the electrodes 3, the dimples 5 being curved concave in a concave direction directed from the front surface 4*b* of the insulating layer 4 toward the back surface 4*a* of the insulating layer 4. Each of the electrodes 3 includes a dimple-corresponding portion 6 curved concave in the concave direction together with one of the dimples 5 at the corresponding location.

The production method includes a step of placing at least one first droplet L1 containing a radionuclide and at least one second droplet L2 containing a labeling substance on at least two respective dimples 5 among the dimples 5 on the front surface 4*b* of the insulating layer 4. The production method also includes a step of obtaining a liquid mixture M by using a change in electrostatic force caused by changing voltage applied to the electrodes 3 to thereby cause a relative movement between the at least one first droplet L1 and the at least one second droplet L2 so that the at least one first droplet L1 and the at least one second droplet L2 are mixed together at any one dimple among the dimples 5. Thus, by using a change in electrostatic force to thereby stop first and second droplets L1 and L2 at dimples 5 and cause a movement of at least one of the first and second droplets L1 and L2 between dimples 5 on the front surface 4*b* of the insulating layer 4 of the liquid manipulation device 1, the production method can increase the accuracy and speed with which the first droplet L1, the second droplet L2, and the like are mixed together.

The method for producing a radioactive composition according to the present embodiment further includes a step of stirring the liquid mixture M by using a change in the electrostatic force to thereby cause a movement of the liquid mixture M between two adjacent dimples among the dimples 5 at least once.

In the production method, a liquid mixture M can be stirred efficiently by causing a movement of the liquid mixture M among dimples 5. Thus, a first droplet L1 and a second droplet L2 can be mixed together with increased accuracy, and reaction can be accelerated between a compound in the first droplet L1 and a compound in the second droplet L2.

In the method for producing a radioactive composition according to the present embodiment, the first droplet L1 contains a radionuclide selected from $^{99m}$Tc, $^{111}$In, $^{67}$Ga, $^{123}$I, $^{68}$Ga, $^{64}$Cu, $^{89}$Zr, $^{18}$F, $^{63}$Zn, $^{44}$Sc, $^{124}$I, $^{90}$Y, $^{23}$Ra, $^{211}$At, $^{225}$Ac, $^{177}$Lu, $^{131}$I, and $^{89}$Sr. Thus, the production method is advantageous for on-site production of a radioactive composition suitable for synthesis through reaction at room temperature.

In the method for producing a radioactive composition according to the present embodiment, in the step of placing, at least one third droplet L3 containing a pH adjuster is also placed on at least one dimple among the dimples 5, the at least one dimple being different from the at least two respective dimples 5 at which the at least one first droplet L1 and the at least one second droplet L2 are placed, and in the step of obtaining the liquid mixture M, by using a change in the electrostatic force, a relative movement is caused between the at least one first droplet L1, the at least one second droplet L2, and the at least one third droplet L3 so that the at least one first droplet L1, the at least one second droplet L2, and the at least one third droplet L3 are mixed together at any one dimple among the dimples 5. Thus, when a final objective substance is generated through reaction requiring a substance for pH adjustment in addition to a radionuclide and a labeling substance, pH can be adjusted on the liquid manipulation device 1.

With the production method of the present invention, production of a radioactive composition can be fully automated, and a radioactive composition containing a very small amount of a radiopharmaceutical substance in high concentration can be prepared using a high concentration of a starting substance conventionally unusable due to the risk of the human body exposure to radiation. In particular, the method is advantageous for on-site production at medical institutions using nuclides with short half-lives and/or expensive labeling substances as starting substances. Furthermore, the production method of the present invention can eliminate devices including valves and tubes, thus achieving a reduced level of dead volume in comparison with conventional methods. The liquid manipulation device can be disposable and, after use, leave an insignificant amount of waste to be disposed of. Thus, the contamination of devices with radioactivity can be minimized, and the time and effort needed to manage and dispose of devices in conventional methods can be significantly reduced. More specifically, a radioactive composition is conventionally synthesized in a hot cell to provide protection from radiation exposure, and limited sizes within a hot cell impose constraints on the size of a device to be installed within the hot cell. Additionally, a clinical problem exists that synthesizing more than one drug requires the same number of synthesis devices because one device is used for one drug. The liquid manipulation device used in the production method of the present invention is small enough to allow disposal of only the part of devices which has touched radioactive substances. Thus, it is possible to synthesize different compositions simultaneously within a hot cell and thereby solve the problems posed by the conventional methods. Furthermore, the production method of the present invention can be used for personalized medicine because the method enables synthesis of a radioactive composition in a small amount, and thus, one dose for an individual can be easily synthesized. Additionally, the method can be used to produce a radioactive composition for administration to laboratory animals, such as a mouse, for which dosage is significantly smaller than that for humans.

Although an embodiment of the present invention has been described above, the present invention is not limited to the aforementioned embodiment, and it can be modified or changed based on the technical concept of the present invention.

Example

As an Example, a radioactive composition was produced using a liquid manipulation device 1 shown in outline in FIGS. 1 to 6. The radioactive composition prepared was an injection containing diethylenetriamine pentaacetic acid technetium (technetium [$^{99m}$Tc]-DTPA) as a radiopharmaceutical substance. This injection is, in general, used as a scintigraphy reagent for the diagnosis of kidney disease, and it is known to be prepared by mixing a diethylenetriamine pentaacetic acid solution as a labeling substance and a sodium pertechnetate solution based on the Minimum Requirements for Radiopharmaceuticals.

As a first droplet L1, 10 μL of a sodium pertechnetate solution (4.89 MBq/mL) was used. As a second droplet L2, 10 μL of a diethylenetriamine pentaacetic acid solution (0.05 mg/μL, Techne (Registered Trade Mark) DTPA Kit manufactured by FUJIFILM Toyama Chemical Co., Ltd.) was used. The radiation dose was measured using IGC-8 Aloka Curiemeter (manufactured by Hitachi Aloka Medical, Ltd.).

The liquid manipulation device 1 used was configured as shown in FIGS. 1 to 6. The liquid manipulation device 1 was created by forming, on a substrate 2 of paper having a thickness of 300 μm, electrode 3 patterns, using 10 tiles having concave and convex portions, and a wiring of conductive ink using an ink-jet printer. In the present Example, the tiles each had a dimension of 2×2 mm and were placed at 300 μm spacings to manipulate 5 μL and 30 μL droplets. An insulating layer 4 was made using a fluorine-based insulating film having a thickness of 10 μm. Dimples 5 were formed by performing an embossing process on a laminate of the paper substrate 2, the electrodes 3 made of conductive ink, and the insulating layer 4 of the fluorine-based insulating film. Each of the dimples 5 had a diameter of 2 mm and a maximum depth of 47 μm.

The placing step and the mixing step for the first droplet L1 and the second droplet L2 in the Example were performed as in the embodiment that uses the device shown in FIG. 4. The first and second droplets L1 and L2 were moved by applying a voltage of 300 V at one-second time intervals. First, the first droplet L1 of 10 μL was placed at one dimple 5, and the second droplet L2 of 10 μL was placed at another dimple 5. Then, the first droplet L1 was moved as indicated by the arrow R1 in FIG. 4. Subsequently, the second droplet L2 was moved as indicated by the arrow R2 in FIG. 4 to mix the two droplets L1 and L2 together. Then, the resultant liquid mixture M was stirred by moving the liquid mixture M between nine dimples 5 as indicated by an arrow N in FIG. 5. In other words, the stirring step was performed. The liquid mixture M at one dimple 5 as shown in FIG. 6 was collected five minutes after the stirring step was completed.

The efficiency of the synthesis of technetium [$^{99m}$Tc]-DTPA was evaluated by thin-layer chromatography (TLC). An autoradiograph of the product was obtained by scanning using an Amersham Typhoon scanner (manufactured by GE Healthcare). The evaluation by TLC demonstrated that the efficiency of the synthesis of technetium [$^{99m}$Tc]-DTPA was approximately 99.3% (not shown). Additionally, an autoradiograph of the used liquid manipulation device 1 showed almost no radioactive substance on the dimples 5 used to move the droplets. Therefore, it was verified that, by using the production method according to the present invention, a high synthesis rate as described above can be achieved, and the task of removing unreacted chemicals, necessary with conventional methods, may be eliminated in the future.

Industrial Applicability

The method for producing a radioactive composition according to the present invention is advantageous for synthesis of a clinically usable pharmaceutical for diagnosis and a pharmaceutical for laboratory diagnosis. In particular, the method is advantageous for synthesis of small amounts of a pharmaceutical for diagnosis.

Reference Signs List

1 liquid manipulation device
2 substrate, 2*b* front surface
3 electrode
4 insulating layer, 4*a* back surface, 4*b* front surface
5 dimple
6 dimple-corresponding portion
L1 first droplet, L2 second droplet, L3 third droplet
M liquid mixture

What is claimed is:

1. A method for producing a radioactive composition using a liquid manipulation device, the device comprising:

a substrate;

electrodes located on a front surface of the substrate; and an insulating layer located on the front surface of the substrate to cover the electrodes, the insulating layer having a back surface facing the front surface of the substrate and a front surface located opposite the back surface of the insulating layer with respect to a thickness direction of the insulating layer, the insulating layer including dimples at locations corresponding to respective locations of the electrodes, the dimples being curved concave in a concave direction directed from the front surface of the insulating layer toward the back surface of the insulating layer, each of the electrodes including a dimple-corresponding portion curved concave in the concave direction together with one of the dimples at a corresponding location, the production method comprising:

placing at least one first droplet containing a radionuclide and at least one second droplet containing a labeling substance on at least two respective dimples among the dimples on the front surface of the insulating layer; and obtaining a liquid mixture by using a change in electrostatic force caused by changing voltage applied to the electrodes to thereby cause a relative movement between the at least one first droplet and the at least one second droplet so that the at least one first droplet and the at least one second droplet are mixed together at any one dimple among the dimples.

2. The method for producing a radioactive composition according to claim 1, further comprising stirring the liquid mixture by using a change in the electrostatic force to thereby cause a movement of the liquid mixture between two adjacent dimples among the dimples at least once.

3. The method for producing a radioactive composition according to claim 1, wherein the first droplet contains a radionuclide selected from $^{99m}$Tc, $^{111}$In, $^{67}$Ga, $^{123}$I, $^{68}$Ga, $^{64}$Cu, $^{89}$Zr, $^{18}$F, $^{63}$Zn, $^{44}$Sc, $^{124}$I, $^{90}$Y, $^{223}$Ra, $^{211}$At, $^{225}$Ac, $^{177}$Lu, $^{131}$I, and $^{89}$Sr.

4. The method for producing a radioactive composition according to claim 1, wherein, in the placing, at least one third droplet containing a pH adjuster is also placed on at least one dimple among the dimples, the at least one dimple being different from the at least two respective dimples at which the at least one first droplet and the at least one second droplet are placed, and in the obtaining the liquid mixture, by using a change in the electrostatic force, a relative movement is caused between the at least one first droplet, the at least one second droplet, and the at least one third droplet so that the at least one first droplet, the at least one second droplet, and the at least one third droplet are mixed together at any one dimple among the dimples.

* * * * *